US011183762B2

(12) United States Patent
Kuhn et al.

(10) Patent No.: US 11,183,762 B2
(45) Date of Patent: Nov. 23, 2021

(54) HIGH-PERFORMANCE MAGNETIC-INDUCTIVE ANTENNA FOR A HEARING INSTRUMENT, HEARING INSTRUMENT AND METHOD FOR PRODUCING THE ANTENNA

(71) Applicant: SIVANTOS PTE. LTD., Singapore (SG)

(72) Inventors: Johannes Kuhn, Fuerth/Burgfarnbach (DE); Peter Nikles, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 92 days.

(21) Appl. No.: 16/548,105

(22) Filed: Aug. 22, 2019

(65) Prior Publication Data

US 2020/0068326 A1 Feb. 27, 2020

(30) Foreign Application Priority Data

Aug. 22, 2018 (DE) ..... 10 2018 214 199.1

(51) Int. Cl.
*H01Q 7/08* (2006.01)
*H04R 25/00* (2006.01)

(52) U.S. Cl.
CPC ..... *H01Q 7/08* (2013.01); *H04R 25/55* (2013.01); *H04R 25/70* (2013.01)

(58) Field of Classification Search
CPC ..... H04R 25/70; H04R 25/55; H04R 25/554; H04R 2225/51; H01Q 7/08; H01Q 7/06; H01Q 1/38; H01Q 1/273
See application file for complete search history.

(56) References Cited

U.S. PATENT DOCUMENTS

| | | | | |
|---|---|---|---|---|
| 7,777,680 | B2 | 8/2010 | Abe et al. | |
| 8,698,685 | B2 * | 4/2014 | Ito | H01Q 7/08 343/788 |
| 9,609,443 | B2 | 3/2017 | Ruaro et al. | |
| 10,320,086 | B2 | 6/2019 | Kerselaers et al. | |
| 10,362,419 | B2 | 7/2019 | Kuhn et al. | |
| 2007/0132648 | A1 * | 6/2007 | Abe | H01Q 1/273 343/718 |
| 2008/0309446 | A1 | 12/2008 | Guenther et al. | |
| 2012/0093324 | A1 * | 4/2012 | Sinasi | H04R 25/552 381/23.1 |
| 2015/0016645 | A1 * | 1/2015 | Bauman | H01Q 7/08 381/315 |

(Continued)

FOREIGN PATENT DOCUMENTS

| | | | |
|---|---|---|---|
| CN | 106375920 | A | 2/2017 |
| CN | 107453037 | A | 12/2017 |

(Continued)

*Primary Examiner* — Oyesola C Ojo
(74) *Attorney, Agent, or Firm* — Laurence A. Greenberg; Werner H. Stemer; Ralph E. Locher

(57) ABSTRACT

A magnetic-inductive antenna for a hearing instrument includes two antenna surfaces which are formed from magnetic, flexible foil, and a base which is wound with an antenna winding. The antenna surfaces are formed from magnetic foil blanks which are separated from one another. The base has, at each of its end sides, a respective opening into which a respective one of the foil blanks is inserted. A hearing instrument and a method for producing a magnetic-inductive antenna for a hearing instrument are also provided.

19 Claims, 4 Drawing Sheets

(56) References Cited

U.S. PATENT DOCUMENTS

| | | | | |
|---|---|---|---|---|
| 2015/0036854 | A1* | 2/2015 | Polinske | H04R 25/554 381/315 |
| 2015/0296312 | A1* | 10/2015 | Nikles | H04R 25/554 381/315 |
| 2019/0006757 | A1 | 1/2019 | Nikles et al. | |
| 2019/0116435 | A1* | 4/2019 | Hesselballe | H01Q 1/273 |

FOREIGN PATENT DOCUMENTS

| | | | |
|---|---|---|---|
| DE | 102005026410 | A1 | 12/2006 |
| DE | 102010024439 | A1 | 1/2011 |
| EP | 1906270 | A2 | 4/2008 |
| GN | 108076423 | A | 5/2018 |
| WO | 2017153274 | A1 | 9/2017 |

* cited by examiner

HIGH-PERFORMANCE MAGNETIC-INDUCTIVE ANTENNA FOR A HEARING INSTRUMENT, HEARING INSTRUMENT AND METHOD FOR PRODUCING THE ANTENNA

CROSS-REFERENCE TO RELATED APPLICATION

This application claims the priority, under 35 U.S.C. § 119, of German Patent Application DE 10 2018 214 199.1, filed Aug. 22, 2018; the prior application is herewith incorporated by reference in its entirety.

BACKGROUND OF THE INVENTION

Field of the Invention

The invention relates to a magnetic-inductive antenna for a hearing instrument, as well as a hearing instrument, in particular a hearing device, including such an antenna. The invention also relates to a method for producing the antenna.

The term hearing instrument generally refers to electronic devices which output a sound signal into the ear of a person wearing the hearing instrument (also referred to as "user" or "wearer") and therefore assist the person with respect to hearing. In the narrower sense, the term hearing instrument covers, in particular, hearing devices which are used to treat hearing-impaired wearers. Hearing devices of that kind receive ambient sound and output it in processed form, in particular in a form amplified in a frequency-dependent manner, as air-borne and/or structure-borne sound to the user, wherein the sound fully or at least partially compensates for the hearing loss of the user. Further hearing instruments process—similarly to conventional hearing devices—received ambient sound, but are used to treat users with normal hearing in order to improve their hearing ability in particular situations (for example special sound-damping hearing instruments for musicians) or to assist them in other ways. However, in that case and below, hearing instruments are also understood to mean devices which convert a wire-bound or wirelessly received audio signal into air-borne or structure-borne sound and output it in that form to the user, for example headphones, earpieces, etc.

Different configurations of hearing instruments are known. For example, so-called "behind-the-ear devices" are worn between the cranium and the pinna, wherein the amplified sound signal is routed into the auditory canal of the person by using a sound tube or is output by using a sound transducer (also referred to as a "receiver") which is situated in the ear canal. A further configuration of a hearing instrument is an "in-the-ear device" in which the entire hearing aid itself is inserted into the ear, in particular into the auditory canal. Hearing instruments which transmit the sound information in the form of structure-borne sound, for example so-called cochlear implants, are also available.

In hearing instruments, magnetic-inductive near-field transmission is used as an alternative to conventional radio transmission techniques (for example Bluetooth) for the wireless transmission of data, in particular audio signals, with external devices. In particular, magnetic-inductive near-field transmission is often used for communication between two hearing instruments of a binaural hearing system.

Furthermore, magnetic-inductive methods are also used for energy transmission, that is to say for wirelessly charging rechargeable batteries in hearing instruments.

Up until now, the MI antennas required for that purpose (that is to say for magnetic-inductive data and/or energy transmission) were generally produced by a simple wound ferrite core. The antenna power could be increased in that case by virtue of larger ferrite cores, special winding and particular ferrite materials. However, due to the limited installation space, the sensitive electronics in hearing instruments (which electronics are therefore susceptible to faults), and the desire for as low a weight as possible, increasing the power of conventional MI antennas for use in hearing instruments is subject to strict limits.

International Publication WO 2017/153274 A1, corresponding to U.S. Patent Application Publication No. 2019/0006757 A1, describes a concept for novel magnetic-inductive antennas (abbreviated as MI antennas, that is to say antennas for magnetic-inductive near-field transmission) in which the cross section of the actual winding core (referred to below as the base) is extended by flat magnetic foils. Those antenna surfaces (referred to therein as "shields") are oriented approximately orthogonally in relation to the axis of the winding core in that case. The antenna surfaces are, on the mutually facing inner sides, optionally provided with a paramagnetic or diamagnetic layer by way of which the interior space formed between the antenna surfaces is magnetically shielded. Therefore, electrical or electronic components of the hearing device (for example the battery) can be accommodated in an installation space-saving manner in the interior space between the antenna surfaces.

SUMMARY OF THE INVENTION

It is accordingly an object of the invention to provide a high-performance magnetic-inductive antenna for a hearing instrument, a hearing instrument and a method for producing the antenna, which overcome the hereinafore-mentioned disadvantages of the heretofore-known antennas, instruments and methods of this general type and which further improve a foil-type antenna, in particular in terms of production-related aspects.

With the foregoing and other objects in view there is provided, in accordance with the invention, an MI antenna, comprising two antenna surfaces which are formed from magnetic, flexible foil. The MI antenna further includes a base which is wound with an antenna winding. According to the invention, the two antenna surfaces are formed from magnetic foil blanks which are separated from one another. In this case, the base has, at the end sides (that is to say the surfaces which are situated opposite to one another in the direction of the winding axis), a respective opening into which a respective one of the foil blanks (in particular by way of a lug) is inserted.

The MI antenna according to the invention has the advantage that the base can be prefabricated separately from the antenna surfaces, wherein, in particular, the antenna winding can be (and preferably also is) soldered by using a reflow process in a manner which is expedient with respect to manufacture. The foil blanks are only subsequently inserted into the openings of the prefabricated base. This production concept allows simple, automated production using conventional production machines. In addition, extensive overlapping of the foil blanks with one another or with a ferrite core of the base can be achieved by using the inserted foil blanks, as a result of which efficient magnetic flux between the base and the antenna surfaces and therefore a high degree of antenna efficiency are achieved.

With the objects of the invention in view, there is also provided a hearing instrument which is fitted with the MI antenna according to the invention, in particular a hearing device.

With the objects of the invention in view, there is furthermore provided a method for producing an MI antenna, the method comprising:

- in a first step, a base which is wound with an antenna winding is produced, so that openings are left free at the end sides (as defined above) of this base; in this first step, the antenna winding is preferably soldered to corresponding contact areas on the base,
- in a second step, two antenna surfaces are produced from magnetic foil as foil blanks, which are separated from one another, and
- in a third step, the foil blanks are connected to the base due to each of the two foil blanks being inserted into a respective one of the openings of the base (in particular by way of an associated lug).

In this case, the first step and the second step are independent of one another. Therefore, these steps can be carried out in any desired order with respect to time (in particular also simultaneously or with a time overlap). However, the third step is based on the result of the preceding steps and therefore has to be executed after those steps.

Within the scope of the invention, the foil blanks can have any desired outer contour in principle. In suitable embodiments, the antenna surfaces have, for example, a respective circular, semicircular or polygonal outer contour. The lugs which are to be inserted into the corresponding recesses of the base are preferably narrower than the associated antenna surface (that is to say have a smaller width than the antenna surface) and project from the edge of the antenna surface.

Preferred refinement features and variants of the invention:

- a base with a hollow (in particular integral) main body, preferably a ferrite core, alternatively a (winding) support composed of non-magnetic material, such as plastic or ceramic for example, into which the two foil blanks are inserted in such a way that they overlap or butt against one another in the interior of the main body (optional clamping of the foil blanks by wedges which are introduced at the end side into the main body through the openings)
- a sandwich-like base with a support composed of non-magnetic material (plastic, ceramic, etc.) and with a ferrite core, wherein the foil blanks are inserted between the support and the ferrite core
- a connection of the antenna winding by using a—preferably flexible—printed circuit mount (printed circuit board abbreviated as PCB) which, on one side, is placed against the ferrite core or support of the base or is folded around the ferrite core or support
- a ferrite core or support is coated with electrical contact areas for making contact with the antenna winding
- a base with a ferrite core which has at least one recess for receiving a lug of one of the foil blanks, and also with a covering layer which covers the or each recess; variants:
  - two recesses, which are separated from one another, for a respective lug
  - one recess, which is continuous from end side to end side, for receiving the lugs of both foil blanks
- a diamagnetic or paramagnetic layer (preferably composed of copper) is applied to the respective inner side of the foil blanks, in particular in the region of the antenna surfaces (lugs in the overlap region without diamagnetic or paramagnetic coating).

Other features which are considered as characteristic for the invention are set forth in the appended claims.

Although the invention is illustrated and described herein as embodied in a high-performance magnetic-inductive antenna for a hearing instrument, a hearing instrument and a method for producing the antenna, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
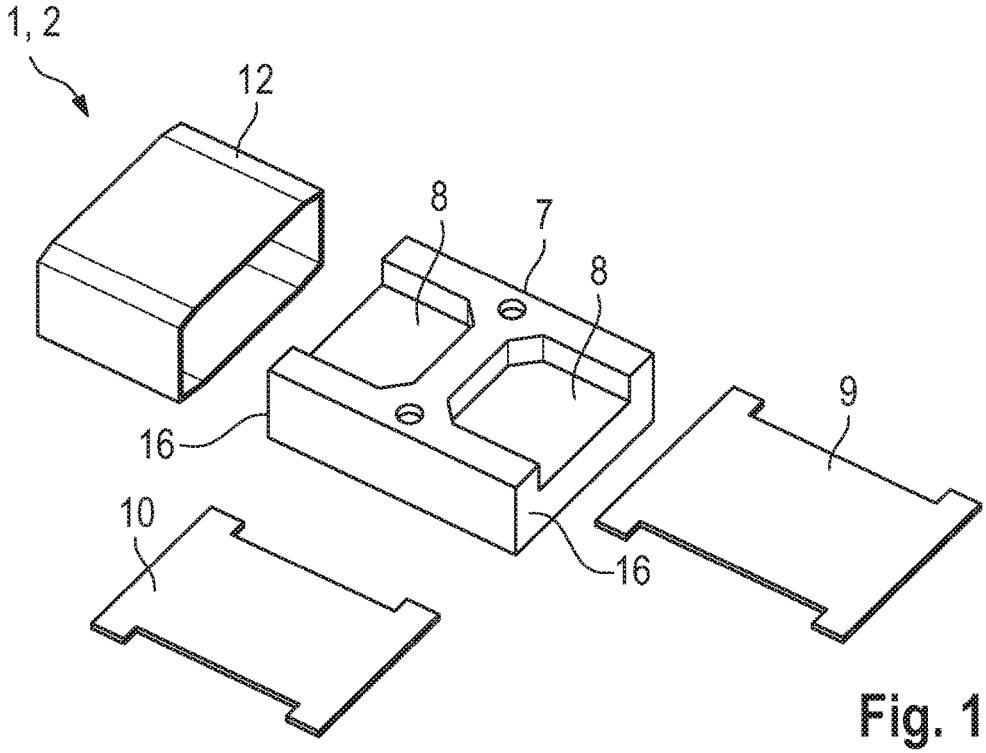
FIG. 1 is a diagrammatic, exploded, perspective view of a base of a first exemplary embodiment illustrated in FIGS. 1-3.
Figure 2:
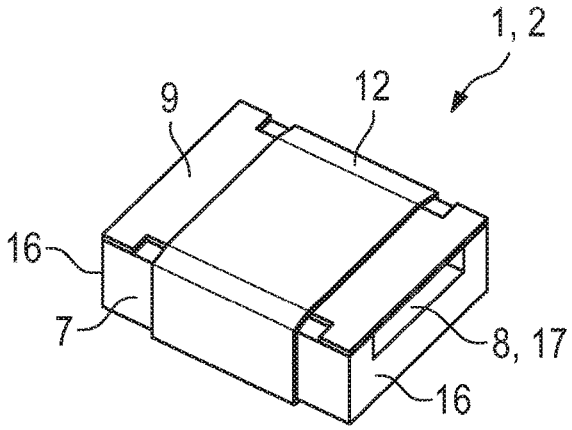
FIG. 2 is a perspective view of the base of the first exemplary embodiment as viewed toward a covering surface.
Figure 3:
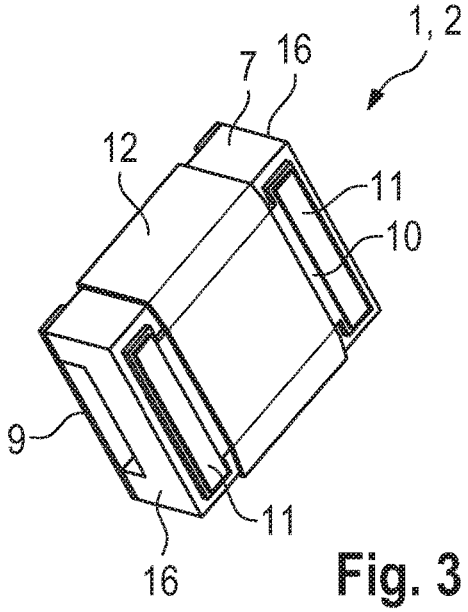
FIG. 3 is a perspective view of the base of the first exemplary embodiment as viewed toward a bottom.

Referring now to the figures of the drawings in detail and first, particularly, to FIGS. 1-3 thereof, there is seen a first exemplary embodiment of an MI antenna 1 in which a base 2 is formed from:

- a ferrite core 7 with recesses 8, which are separated from one another and are each open to one end side 16, for introducing a respective lug 5 of one of the two foil blanks 3 (the web between the recesses forces the magnetic flux through the ferrite core in this case, as a result of which expedient magnetic coupling of the antenna surfaces 4 to the ferrite core is implemented), a bottom-side PCB 10 (which is averted from the recess) for soldering the antenna winding 12, a covering layer 9 (PCB, PTFE foil, etc.) which covers the recesses 8, and the antenna winding 12, which is wound around the ferrite core 7, the PCB 10 and the covering layer 9, which is soldered to the PCB 10 using a reflow process at contact areas 11 for making contact with the antenna winding.

Figure 4:
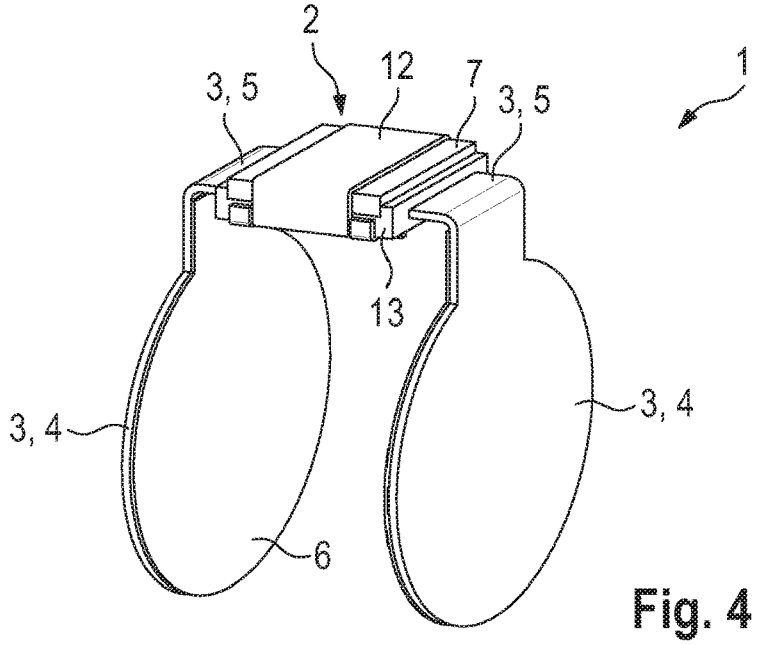
FIG. 4 is a perspective view of the MI antenna with the base and two foil blanks composed of magnetic foil (with inner-side diamagnetic layers composed of copper for magnetically shielding the interior space which is formed between the foil blanks) in the assembled state of a second exemplary embodiment illustrated in FIGS. 4-6.
Figure 10:
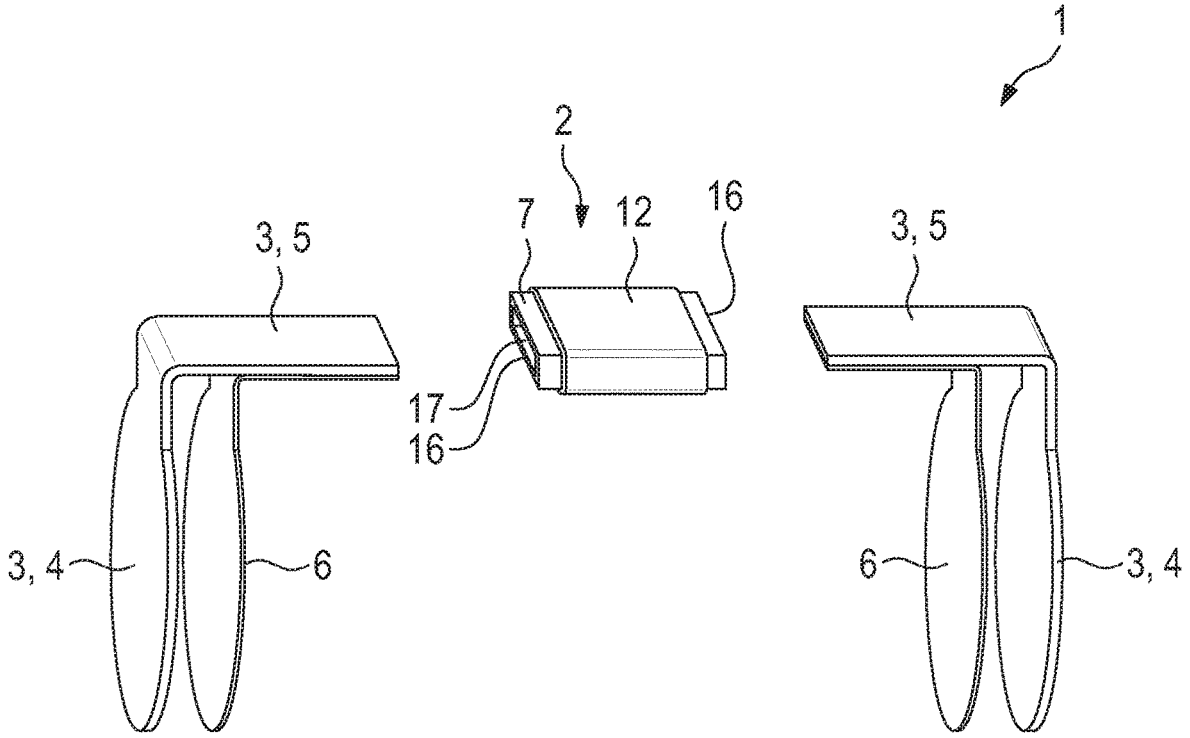
FIG. 10 is an exploded, perspective view a fourth embodiment illustrated in FIGS. 11 and 12 of the MI antenna with a base and two foil blanks.

The non-illustrated foil blanks 3 are constructed as shown in FIGS. 4 and 10 (circular antenna surfaces 4 with a respective lug 5 which projects from the edge side thereof) and are inserted by way of the lugs 5 into the end-side openings 17 of the base 2.

Figure 5:
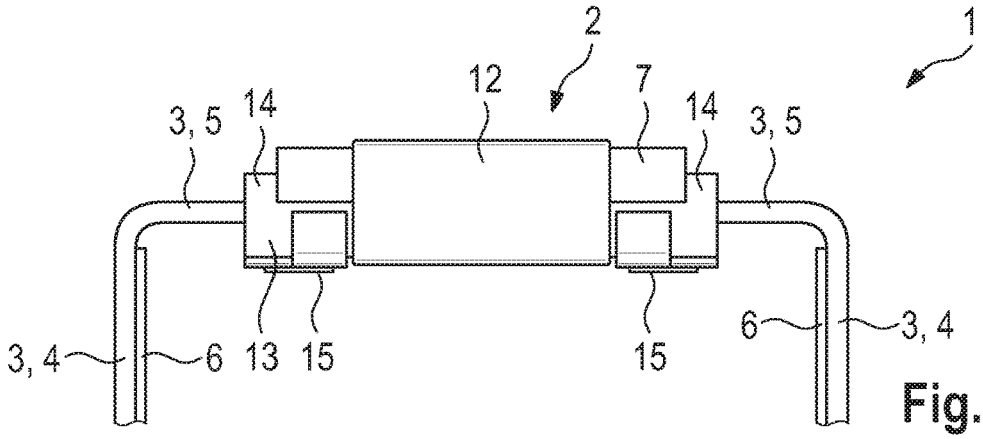
FIG. 5 is a side-elevational view of the MI antenna of the second exemplary embodiment in the assembled state.
Figure 6:
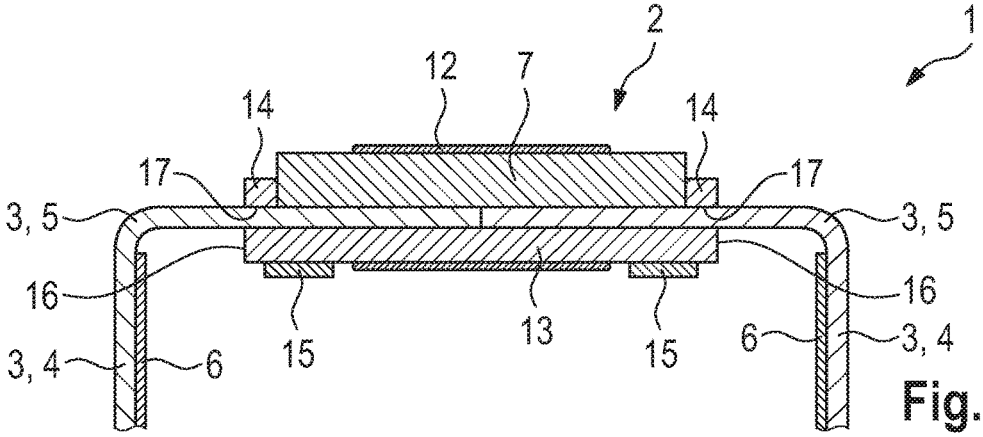
FIG. 6 is a longitudinal-sectional view through the MI antenna of the second exemplary embodiment in the assembled state.

With regard to the second exemplary embodiment illustrated in FIGS. 4-6 and showing the MI antenna 1 with the base 2 and two foil blanks 3 composed of magnetic foil (with inner-side diamagnetic layers 6 composed of copper for magnetically shielding the interior space which is formed between the foil blanks 3) in the assembled state, the base 2 is formed from:

a plastic support 13 with annularly closed end-side brackets 14 for introducing a respective lug 5 of one of the two foil blanks 3 and with an open central region, a ferrite core 7 which is inserted into the open central region of the support, so that it bears extensively against the lugs 5 of the foil blanks 3, which lugs butt against one another, a bottom-side PCB 10 (which is averted from the recess) or conductive coating of the support 13 for soldering the antenna winding 12 at contact areas 15 for making contact with the antenna winding by the conductive coating applied to the support, and the antenna winding 12 which is wound around the support 13 and the ferrite core 7 (and also possibly the PCB 10).

Figure 7:
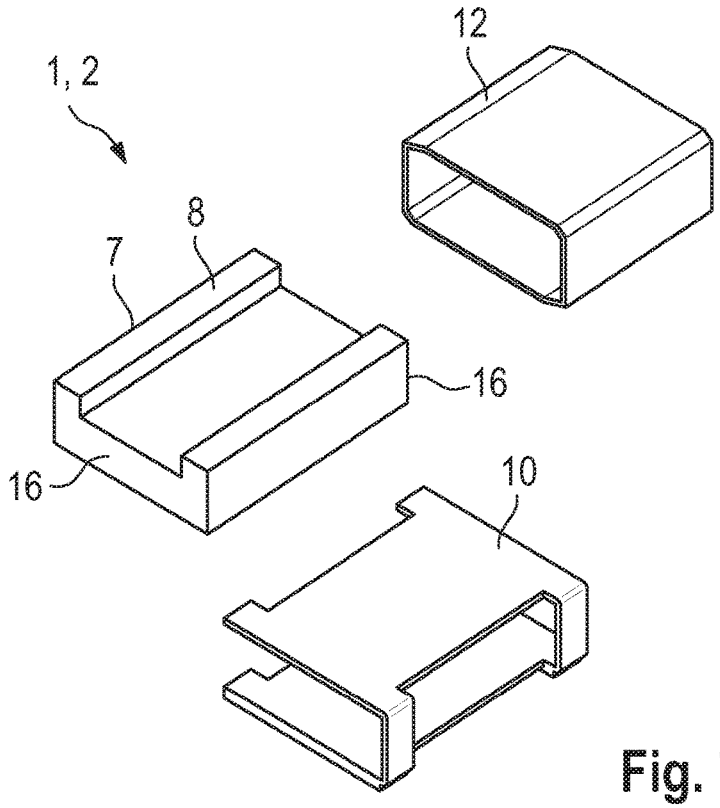
FIG. 7 is an exploded, perspective view of the base of a third exemplary embodiment illustrated in FIGS. 7-9.
Figure 8:
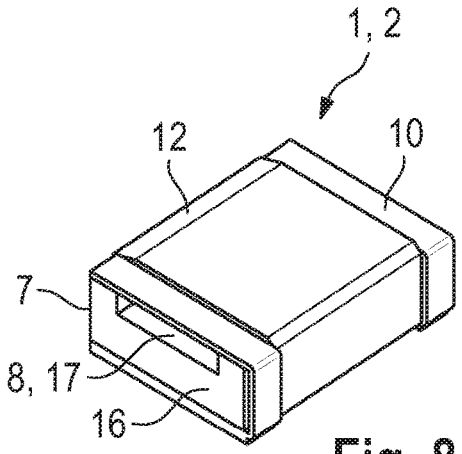
FIG. 8 is a perspective view of the base of the third exemplary embodiment as viewed toward a covering surface.
Figure 9:
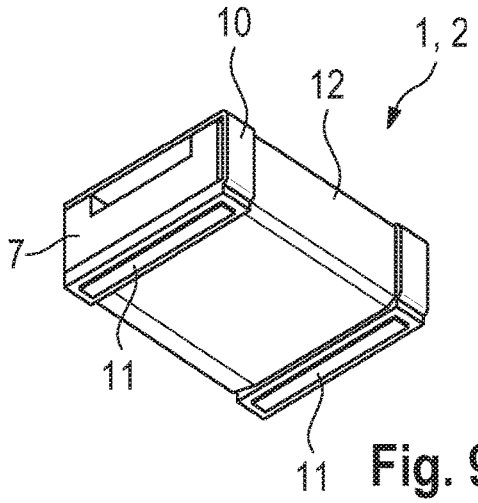
FIG. 9 is a perspective view of the base of the third exemplary embodiment as viewed toward the bottom.

With regard to the third exemplary embodiment illustrated in FIGS. 7-9, a base 2 of an MI antenna 1 is formed from:

a ferrite core 7 with a recess 8, which is continuous from end side 16 to end side 16, for introducing the lugs 5 of both foil blanks 3 (the lugs 5 butt against one another in this recess 8), a PCB 10, which is folded around the ferrite core 7, for soldering the antenna winding 12 at the contact areas 11 and for covering the recess 8, and the antenna winding 12 which is wound around the ferrite core 7 and the PCB 10.

The non-illustrated foil blanks 3 are constructed as shown in FIGS. 4 and 10 (circular antenna surfaces 4 with a respective lug 5 which projects from the edge side thereof) and are inserted by way of the lugs 5 into the end-side openings 17 of the base 2.

Figure 11:
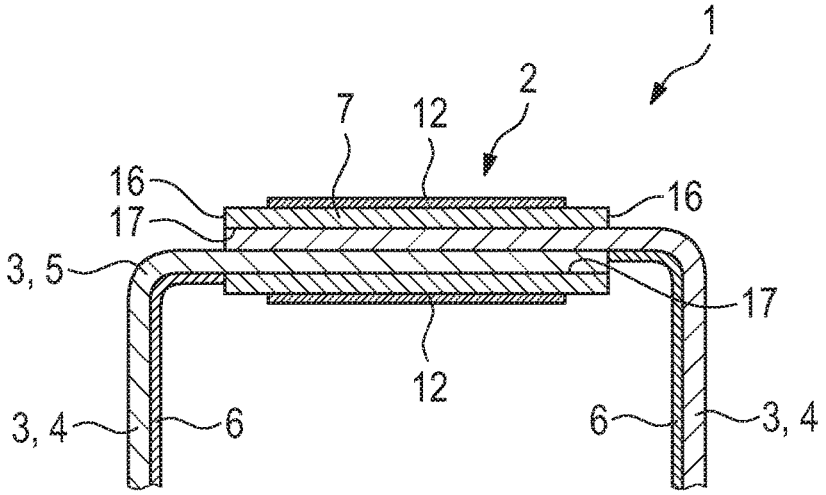
FIG. 11 is a longitudinal-sectional view through the MI antenna of the fourth embodiment in the assembled state.

With regard to the fourth exemplary embodiment of the MI antenna 1 having a base 2 and two foil blanks 3 illustrated in FIGS. 10 and 11, the base 2 is formed from:

a hollow ferrite core 7 in which the lugs 5 bear extensively against one another with an overlap, and the antenna winding 12 which is wound around the ferrite core 7.

In the assembled state, the diamagnetic copper layers 6 bear against the antenna surfaces, as shown in FIGS. 4-6 and 11.

A fifth exemplary embodiment (analogous to FIGS. 10 and 11) is similar to the fourth exemplary embodiment, but with a plastic support instead of a hollow ferrite core.

A sixth non-illustrated exemplary embodiment is similar to the fourth exemplary embodiment, but the lugs 5 butt against one another in the interior of the hollow ferrite core 7.

A seventh non-illustrated exemplary embodiment is similar to the fourth, fifth and sixth exemplary embodiments, but the lugs 5 are clamped in the interior of the hollow ferrite core 7 or plastic support 13 by wedges which are pushed in at the end side.

The MI antenna 1 is preferably used in a hearing instrument which receives ambient noise and outputs it in processed, in particular amplified, form into the ear of a person wearing the hearing instrument. In this case, the MI antenna 1 is intended, in particular, for use in a hearing device, that is to say a hearing instrument which is used to treat hearing-impaired people. In the hearing instrument, the MI antenna 1 is used primarily for wireless data transmission with a peripheral device, for example a further hearing instrument for the other ear, a remote operator control system, etc.

As an alternative or in addition, the MI antenna 1 according to the invention is used as a charging coil for inductive and wireless energy transmission from a charging device, which is not illustrated further, to the hearing instrument.

All of the exemplary embodiments are produced in line with the method according to the invention.

The following is a summary list of reference numerals and the corresponding structure used in the above description of the invention:

1 MI antenna
2 Base
3 Foil blank
4 Antenna surface
5 Lug
6 Diamagnetic layer composed of copper
7 Ferrite core
8 Recess in the ferrite core (for receiving a lug or two lugs)
9 Covering foil
10 PCB
11 Contact area for making contact with the antenna winding (printed conductor track)
12 Antenna winding
13 (Winding) support (plastic)
14 Bracket (of the support)
15 Contact area for making contact with the antenna winding (by a conductive coating applied to the support)
16 End side
17 Opening

The invention claimed is:

1. A magnetic-inductive antenna for a hearing instrument, the antenna comprising:

two antenna surfaces formed of mutually separate magnetic, flexible foil blanks;

an antenna winding; and a base wound with said antenna winding, said base having end sides and a respective opening in each of said end sides for receiving a respective one of said foil blanks, and said base being formed of a hollow main body having an interior into which said two foil blanks are inserted and overlap one another or butt against one another.

2. The antenna according to claim 1, wherein said main body is a ferrite core or a support formed of non-magnetic material.

3. The antenna according to claim 2, wherein said non-magnetic material is plastic or ceramic.

4. The antenna according to claim 1, which further comprises wedges being introduced into said openings at said end sides and clamping said foil blanks in said main body.

5. The antenna according to claim 1, wherein said base includes a support formed of non-magnetic material and a ferrite core, said foil blanks being inserted between said support and said ferrite core.

6. The antenna according to claim 5, wherein said non-magnetic material is plastic or ceramic.

7. The antenna according to claim 2, wherein said base includes a printed circuit mount for electrical connection of said antenna winding, said printed circuit mount having one side placed against said ferrite core or support or being folded around said ferrite core or support.

8. The antenna according to claim 7, wherein said printed circuit mount is flexible.

9. The antenna according to claim 5, wherein said base includes a printed circuit mount for electrical connection of said antenna winding, said printed circuit mount having one side placed against said ferrite core or support or being folded around said ferrite core or support.

10. The antenna according to claim 9, wherein said printed circuit mount is flexible.

11. The antenna according to claim 2, which further comprises electrical contact areas coating said ferrite core or said support for making contact with said antenna winding.

12. The antenna according to claim 5, which further comprises electrical contact areas coating said ferrite core or said support for making contact with said antenna winding.

13. The antenna according to claim 2, wherein:

said foil blanks have lugs;

said ferrite core has at least one recess being open to at least one of said end sides for receiving said lug; and said base has a covering layer covering said at least one recess.

14. The antenna according to claim 5, wherein:

said foil blanks have lugs;

said ferrite core has at least one recess being open to at least one of said end sides for receiving said lug; and said base has a covering layer covering said at least one recess.

15. The antenna according to claim 13, wherein said at least one recess in said ferrite core includes two recesses each configured for receiving a respective lug, and said ferrite core includes a web separating said recesses from one another.

16. The antenna according to claim 14, wherein said at least one recess in said ferrite core includes two recesses each configured for receiving a respective lug, and said ferrite core includes a web separating said recesses from one another.

17. A hearing instrument or hearing device, comprising an antenna according to claim 1.

18. A method for producing a magnetic-inductive antenna for a hearing instrument, the method comprising the following steps:

in a first step, producing a base being wound with an antenna winding and leaving openings free at end sides of the base, and providing the base with a hollow main body having an interior;

in a second step, producing two antenna surfaces from magnetic foil as foil blanks being separated from one another; and in a third step, connecting the foil blanks to the base by inserting each of the two foil blanks through a respective one of the openings in the base into the interior of the main body until the two foil blanks overlap one another or butt against one another.

19. The method according to claim 18, which further comprises, in the first step, soldering the antenna winding to corresponding contact areas on the base.

* * * * *